US010243274B2

(12) United States Patent
Lee

(10) Patent No.: US 10,243,274 B2
(45) Date of Patent: Mar. 26, 2019

(54) SLOT ANTENNA DEVICE

(71) Applicant: E Ink Holdings Inc., Hsinchu (TW)

(72) Inventor: Yu-Ming Lee, Taoyuan (TW)

(73) Assignee: E Ink Holdings Inc., Hsinchu (TW)

( * ) Notice: Subject to any disclaimer, the term of this patent is extended or adjusted under 35 U.S.C. 154(b) by 35 days.

(21) Appl. No.: 15/406,801

(22) Filed: Jan. 16, 2017

(65) Prior Publication Data

US 2017/0244171 A1 Aug. 24, 2017

Related U.S. Application Data

(60) Provisional application No. 62/296,601, filed on Feb. 18, 2016.

(30) Foreign Application Priority Data

Sep. 26, 2016 (CN) ..... 2016 1 0849318

(51) Int. Cl.
*H01Q 13/10* (2006.01)
*H01Q 1/36* (2006.01)
(Continued)

(52) U.S. Cl.
CPC ..... *H01Q 13/106* (2013.01); *H01Q 1/2291* (2013.01); *H01Q 1/243* (2013.01);
(Continued)

(58) Field of Classification Search
None
See application file for complete search history.

(56) References Cited

U.S. PATENT DOCUMENTS 5,850,198 A * 12/1998 Lindenmeier ..... H01Q 1/3275 343/713
6,043,786 A 3/2000 Vannatta et al.
(Continued)

FOREIGN PATENT DOCUMENTS

CN 102738559 10/2012
TW 200908445 2/2009
(Continued)

OTHER PUBLICATIONS

"Office Action of Taiwan Counterpart Application," dated Sep. 19, 2017, p. 1-p. 5.
(Continued)

*Primary Examiner* — Trinh Dinh
(74) *Attorney, Agent, or Firm* — JCIPRNET

(57) ABSTRACT

A slot antenna device including a substrate, a metal layer and a feeding element is provided. The substrate has a first surface and a second surface opposite to the first surface. The metal layer is disposed on the first surface, and includes a slot extending along a first direction. The feeding element is disposed on the second surface, and extended along a second direction, where the first direction is perpendicular to the second direction. A length of the slot is a sum of each quarter wavelength of at least three frequency bands, so that the slot antenna device is operated at the at least three frequency bands. A projection of the feeding element on the first surface crosses the slot, so that the slot is divided into a first section and a second section, where a length of the first section is equal to a length of the second section.

15 Claims, 7 Drawing Sheets

(51) Int. Cl.

| | |
|---|---|
| ***H01Q 5/30*** | (2015.01) |
| ***H01Q 1/22*** | (2006.01) |
| ***H01Q 1/24*** | (2006.01) |
| ***H01Q 5/357*** | (2015.01) |

(52) U.S. Cl.
CPC ..... *H01Q 1/36* (2013.01); *H01Q 5/30* (2015.01); *H01Q 5/357* (2015.01); *H01Q 13/10* (2013.01)

(56) References Cited

U.S. PATENT DOCUMENTS

| | | | | |
|---|---|---|---|---|
| 7,295,160 | B2 * | 11/2007 | Purr | H01Q 9/0407 343/700 MS |
| 7,463,197 | B2 | 12/2008 | Rafi et al. | |
| 8,115,686 | B2 * | 2/2012 | Mumbru | H01Q 5/371 343/700 MS |
| 8,416,145 | B2 | 4/2013 | Shih et al. | |
| 8,489,162 | B1 | 7/2013 | Dou et al. | |
| 8,531,337 | B2 | 9/2013 | Soler Castany et al. | |
| 8,599,084 | B2 * | 12/2013 | Wong | H01Q 1/243 343/749 |
| 9,225,063 | B2 | 12/2015 | Lee | |
| 2005/0162328 | A1 * | 7/2005 | Mori | H01Q 3/44 343/770 |
| 2009/0153410 | A1 * | 6/2009 | Chiang | H01Q 13/08 343/702 |
| 2009/0262028 | A1 * | 10/2009 | Mumbru | H01Q 5/371 343/702 |
| 2010/0085262 | A1 * | 4/2010 | Wolf | H01Q 3/24 343/768 |
| 2010/0117915 | A1 * | 5/2010 | Shachar | H01Q 9/30 343/767 |
| 2010/0123632 | A1 | 5/2010 | Hill et al. | |
| 2010/0245176 | A1 * | 9/2010 | Wong | H01Q 1/243 343/700 MS |
| 2010/0289701 | A1 * | 11/2010 | DeJean | H01Q 9/0414 343/700 MS |
| 2012/0098721 | A1 * | 4/2012 | Wong | H01Q 1/243 343/749 |
| 2013/0099979 | A1 * | 4/2013 | Wong | H01Q 1/243 343/700 MS |
| 2015/0029068 | A1 | 1/2015 | Toyao et al. | |
| 2015/0097745 | A1 * | 4/2015 | Chou | H01Q 13/10 343/767 |
| 2015/0109177 | A1 | 4/2015 | Lavin | |
| 2016/0104928 | A1 * | 4/2016 | Yamaguchi | H05K 3/103 333/238 |
| 2016/0104938 | A1 * | 4/2016 | Hsu | H01Q 13/106 343/767 |
| 2017/0033467 | A1 * | 2/2017 | Huang | H01Q 13/106 |

FOREIGN PATENT DOCUMENTS

| | | |
|---|---|---|
| TW | 200926514 | 6/2009 |
| TW | 201017984 | 5/2010 |

OTHER PUBLICATIONS

Office Action of China Counterpart Application, dated Jan. 3, 2019, pp. 1-9.

* cited by examiner

SLOT ANTENNA DEVICE

CROSS-REFERENCE TO RELATED APPLICATION

This application claims the priority benefits of U.S. provisional application Ser. No. 62/296,601 filed on Feb. 18, 2016 and China application serial no. 201610849318.6, filed on Sep. 26, 2016. The entirety of each of the above-mentioned patent applications is hereby incorporated by reference herein and made a part of this specification.

BACKGROUND OF THE INVENTION

1. Field of the Invention

The present invention generally relates to an antenna device, in particular, to a slot antenna device.

2. Description of Related Art

As the development of wireless charging technology, there have been increasing numbers of portable electronic devices disposed with charging antennae to receive charging signals via a wireless transmission manner, so that the portable electronic devices have a function of wireless charging. Specifically, most of the current charging antennae are designed by adopting a slot antenna structure. However, general slot antenna structures are usually designed to be single-slot structures, so as to emit a single frequency band correspondingly. Therefore, if the slot antennae could be operated at multiple charging frequency bands, a multiple-slots structure has to be designed to emit the other frequency bands, thus designing the slot antenna structures that are capable of being operated at multiple frequency bands becomes complicate. Therefore, designing slot antenna devices that are capable of being operated at multiple frequency bands without having complex slot structures is an important issue at present, so as to reduce a cost of designing and manufacturing the wireless charging devices. Accordingly, several embodiments of the present invention as solutions are provided as follows.

SUMMARY OF THE INVENTION

The present invention provides a slot antenna device, which has a single slot structure, and can be operated at multiple wireless charging frequency bands.

The slot antenna device of the present invention includes a substrate, a metal layer and a feeding element. The substrate has a first surface and a second surface opposite to the first surface. The metal layer is disposed on the first surface, and the metal layer includes a slot extending along a first direction. The feeding element is disposed on the second surface, and extends along a second direction. The first direction is perpendicular to the second direction. A length of the slot is a sum of each quarter wavelength of at least three frequency bands, so that the slot antenna device is operated at the at least three frequency bands. A projection of the feeding element on the first surface crosses the slot, so that the slot is divided into a first section and a second section. A length of the first section is equal to a length of the second section.

In an embodiment of the present invention, the aforementioned first section includes an open end of the slot, and the second section includes a closed end of the slot.

In an embodiment of the present invention, the first section of the aforementioned slot is in a linear shape.

In an embodiment of the present invention, the second section of the aforementioned slot is in a curved shape.

In an embodiment of the present invention, the second section of the aforementioned slot includes a first end, a second end, a first corner and a second corner. The first end and the first corner are both located at a straight line on the first direction. The first corner and the second corner are both located at a straight line on the second direction.

In an embodiment of the present invention, the second section of the aforementioned slot further includes a third corner. The second corner and the third corner are both located at a straight line on the first direction.

In an embodiment of the present invention, the second section of the aforementioned slot further includes a fourth corner. The third corner and the second corner are both located at a straight line on the second direction.

In an embodiment of the present invention, the aforementioned feeding element is a metal microstrip. A resistance value of the feeding element is 50 ohm.

In an embodiment of the present invention, the aforementioned feeding element is in a linear shape.

In an embodiment of the present invention, the aforementioned feeding element has a first line section extending along the first direction and a second line section extending along the second direction. A projection of the second line section on the first surface crosses the slot.

In an embodiment of the present invention, the aforementioned substrate is a flexible circuit substrate, and the substrate is bended along a first reference line on the first direction or bended along a second reference line on the second direction.

In an embodiment of the present invention, the aforementioned first reference line is located at a midline position of a projection of the slot on the second direction.

In an embodiment of the present invention, the aforementioned second reference line is located in the first section of the slot, and does not cross the feeding element.

In an embodiment of the present invention, the aforementioned slot antenna device is used for receiving a charging microwave of the at least three frequency bands. The at least three frequency bands include 915 MHz, 2.45 GHz and 5.25 GHz.

In an embodiment of the present invention, a thickness of the aforementioned substrate is 0.4 mm.

As above, the slot antenna device of the embodiments of the present invention may emit a mode of multiple frequency bands via a single slot structure and a single feeding element, so that the slot antenna device may be operated at multiple charging frequency bands. Therefore, a degree of complexity of the slot structure may be reduced, and a function of wireless charging at multiple frequency bands is provided.

To make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
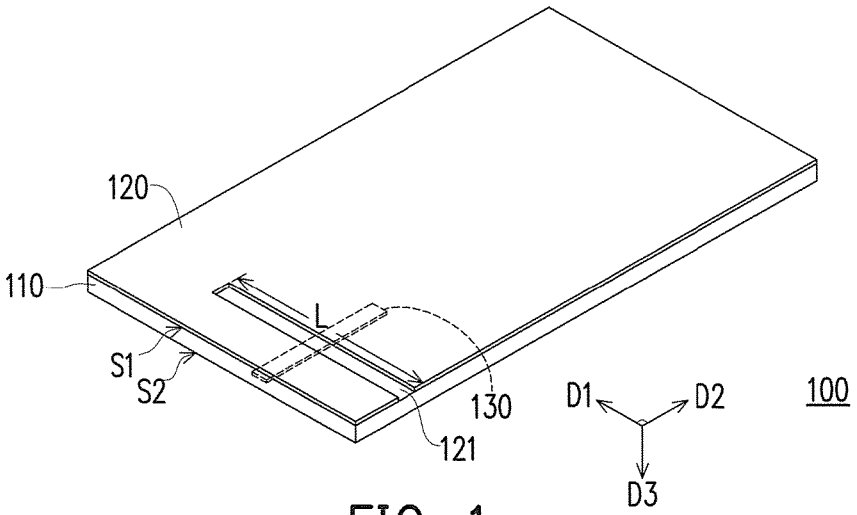
FIG. 1 is a schematic diagram illustrating a slot antenna device according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Multiple embodiments are provided to describe the present invention. However, the present invention should not be limited to these exemplary embodiments. In addition, appropriate combination of the embodiments is also available. Furthermore, in the specification (including the claims) of the present application, antenna devices in embodiments of the present invention may be regarded as being located in a space constructed by a first direction D1, a second direction D2 and a third direction D3, to elaborate locations of slots and feeding elements in the antenna devices of the embodiments of the present invention. The first direction D1 is, for example, substantially perpendicular to the second direction D2. The third direction D3 is a direction that is, for example, substantially perpendicular to the first direction D1 and the second direction D2 simultaneously.

FIG. 1 is a schematic diagram illustrating a slot antenna device according to an embodiment of the present invention. Please refer to FIG. 1, a slot antenna device 100 includes a substrate 110, a metal layer 120 and a feeding element 130. The substrate 110 has a first surface S1 and a second surface S2 opposite to the first surface S1. The metal layer 120 is disposed on the first surface S1 of the substrate 110, and has a slot 121. The feeding element 130 is disposed on the second surface S2 of the substrate 110. In the present embodiment, the metal layer 120 of the slot antenna device 100 is a grounded metal plate, and the slot 121 has an open end and a closed end, wherein the open end of the slot 121 faces a side of the metal layer 120.

In the present embodiment, the feeding element 130 may be a metal microstrip, and a resistance value of the feeding element 130 may be 50 ohm. In addition, in an embodiment, the feeding element 130 may further be electrically connected to a receiver, wherein the receiver may be used to provide feeding signals to emit the slot 121 on the metal layer 120 to generate multiple resonant modes, so that the slot antenna device may be operated at multiple frequency bands. In other words, the slot antenna device 100 may receive charging signals at multiple frequency bands by a manner of wireless transmission via the slot 121. Moreover, a length and a width of the feeding element 130 may be determined according to an impedance matching property, the present invention is not limited thereto.

Specifically, the slot antenna device 100 may emit a mode of multiple frequency bands via a structure of the slot 121 on the metal layer 120 and the feeding element disposed on the second surface S2 of the substrate 110, so that the slot antenna device 100 may be operated at multiple frequency bands. In the present embodiment, a length L of the slot 121 may be determined according to equation (1) through equation (3) as follows.

$$\lambda_0 = C/f \tag{1}$$

$$\lambda_g = \lambda_0/\sqrt{\varepsilon_{eff}} \tag{2}$$

$$L = \lambda_{g1}/4 + \lambda_{g2}/4 + \ldots + \lambda_{gn}/4 \tag{3}$$

It should be noted that, in the equation (1), C denotes light speed. f is a central frequency of a frequency band. $\lambda_0$ is a wavelength of this frequency band in air. In the equation (2), $\lambda g$ is an effective wavelength of this frequency band, $\varepsilon_{eff}$ is an effective dielectric constant of the substrate. In an embodiment, n in the equation (3) is a positive integer that is equal to or larger than 3. Therefore, the length L of the slot 121 of the present embodiment is a sum of each quarter wavelength of at least three frequency bands, so that the slot antenna device 100 is operated at the at least three frequency bands. That is, the slot antenna device 100 may receive charging signals of the at least three frequency bands by a manner of wireless transmission via the slot 121. For example, in the present embodiment, the slot antenna device 100 may be operated at ultra high frequency (UHF) band and IEEE 802.11ac frequency band, to receive wireless charging signals that at least include frequency bands of 915 MHz, 2.45 GHz and 5.25 GHz, but the present invention is not limited thereto. In an embodiment, the length L of the slot 121 may be designed correspondingly according to the wireless charging signals to be received or an amount of the frequency bands.

In addition, in the present embodiment, the slot antenna device 100 may be a printed antenna, and the substrate 110 may be a copper foil substrate (FR-4), so that the antenna structure of the antenna device 100 may be printed on the substrate 110 via a manner of printing, but the present invention is not limited thereto. In an embodiment, the substrate 110 may be a printed circuit board (PCB) or a flexible print circuit (FPC) and so forth.

Regarding the design of slot structure, several different exemplary embodiments are provided in accompany with FIG. 2 through FIG. 5 as follows.

Figure 2:
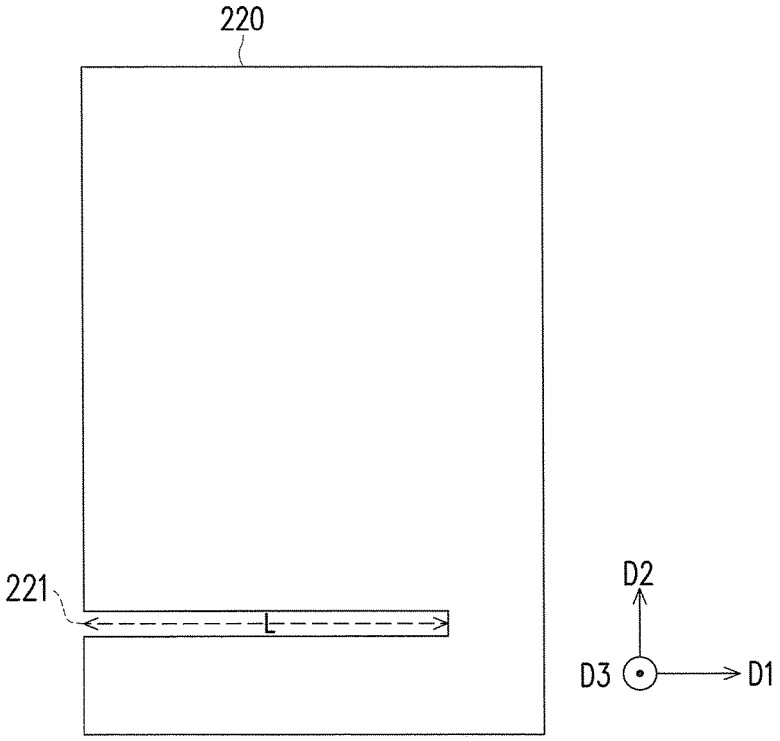
FIG. 2 is a schematic structural diagram illustrating a slot according to an embodiment of the present invention.

FIG. 2 is a schematic structural diagram illustrating a slot according to an embodiment of the present invention. Please refer to FIG. 2, the metal layer 220 has a slot 221 extending along the first direction D1, and an open end of the slot 221 faces a side of the metal layer 220. In the present embodiment, the slot 221 may be in a linear shape, and has the open end and a closed end. Specifically, the slot 221 of the present embodiment is an opened-slot antenna structure. A length L of the slot 221 may be determined according to the aforementioned equation (1) through equation (3). In other words, in the present embodiment, the slot 221 may be used for receiving charging signals of at least three frequency bands, and the length L of the slot 221 is a sum of each quarter wavelength of the three frequency bands. Moreover, the position where the slot 221 is located in the metal layer 220 is not limited by the position shown in FIG. 2, the present invention is not limited thereto.

Figure 3:
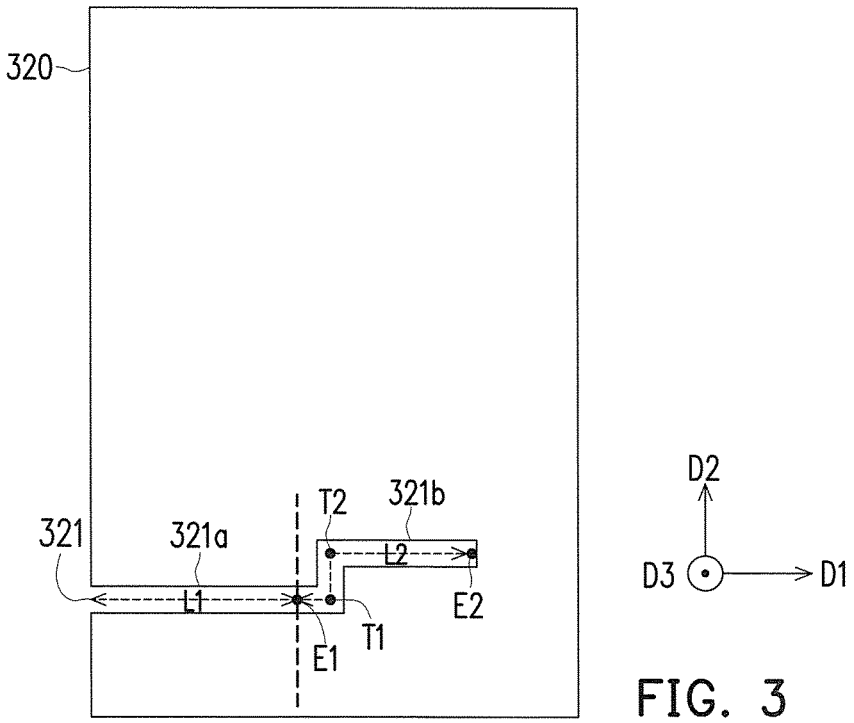
FIG. 3 is a schematic structural diagram illustrating a slot according to another embodiment of the present invention.

FIG. 3 is a schematic structural diagram illustrating a slot according to another embodiment of the present invention. Please refer to FIG. 3, the metal layer 320 has a slot 321, and an open end of the slot 321 faces a side of the metal layer 320. In the present embodiment, the slot 321 may include a section extending along the first direction D1 and a section extending along the second direction D2. In the present embodiment, the slot 321 may be divided into a first section 321*a* and a second section 321*b*, and a length L1 of the first section 321*a* is equal to a length L2 of the second section 321*b*. That is, the lengths of the first section 321*a* and the second section 321*b* may be determined according to equation (4) as follows.

$$L1=L2=L/2 \quad (4)$$

Specifically, the first section 321*a* of the slot 321 may be in a linear shape, and the second section 321*b* of the slot 321 may be in a curved shape. In the present embodiment, the second section 321*b* of the slot 321 may include a first end E1, a second end E2, a first corner T1 and a second corner T2. In the present embodiment, the first end E1 and the first corner T1 are both located at a straight line on the first direction D1. The first corner T1 and the second corner T2 are both located at a straight line on the second direction D2. It should be noted that, comparing to the embodiment of FIG. 2, a matching property of the slot antenna device while receiving charging signals of high frequency bands may be improved via the slot 321 as a result of the curved shape of the second section 321*b*.

Figure 4:
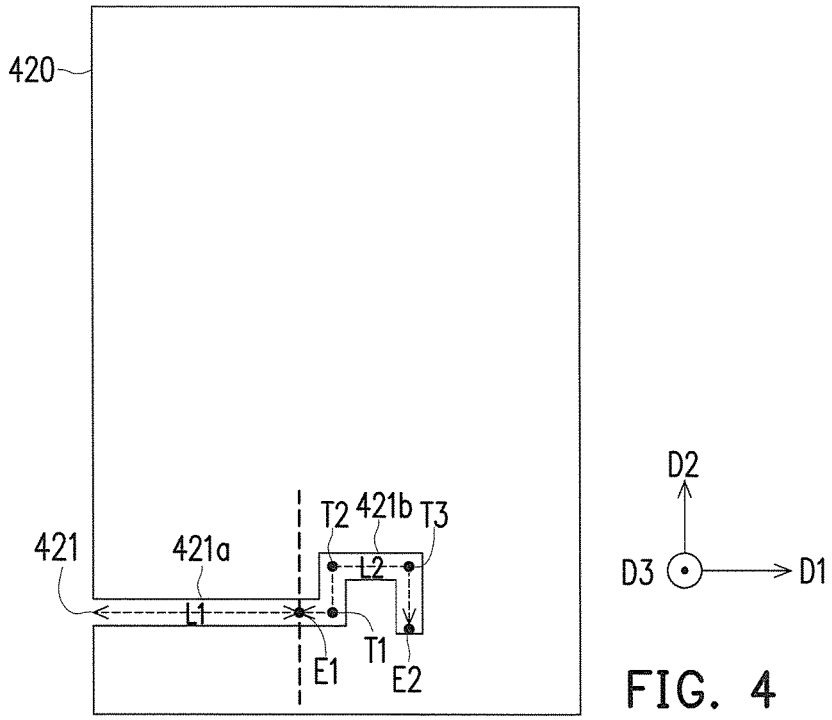
FIG. 4 is a schematic structural diagram illustrating a slot according to another embodiment of the present invention.

FIG. 4 is a schematic structural diagram illustrating a slot according to another embodiment of the present invention. Please refer to FIG. 4, a metal layer 420 includes a slot 421, and an open end of the slot 421 faces a side of the metal layer 420. In the present embodiment, the slot 421 may include a section extending along the first direction D1 and a section extending along the second direction D2. In the present embodiment, the slot 421 may be divided into a first section 421*a* and a second section 421*b*, and a length L1 of the first section 421*a* is equal to a length L2 of the second section 421*b*.

Specifically, the first section 421*a* of the slot 421 may be in a linear shape, and the second section 421*b* of the slot 421 may be in a curved shape. In the present embodiment, the second section 421*b* of the slot 421 may include a first end E1, a second end E2, a first corner T1, a second corner T2 and a third corner T3. In the present embodiment, the first end E1 and the first corner T1 are both located at a straight line on the first direction D1. The first corner T1 and the second corner T2 are both located at a straight line on the second direction D2. The second corner T2 and the third corner T3 are both located at a straight line on the first direction D1. It should be noted that, comparing to the embodiment of FIG. 3, the second section 421*b* of the slot 421 of the present embodiment further includes the third corner T3, so as to further improve the matching property of the slot antenna device while receiving charging signals of high frequency bands.

Figure 5:
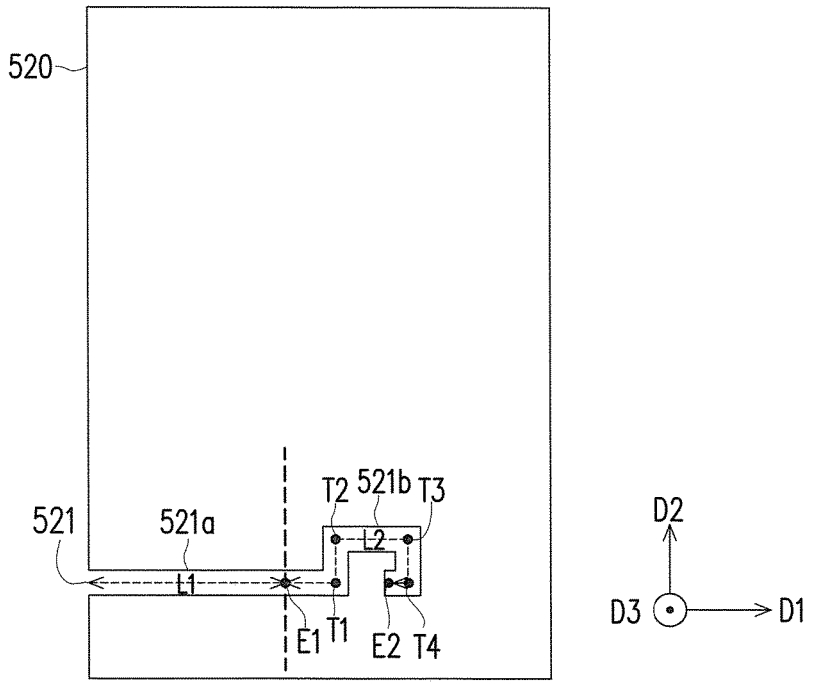
FIG. 5 is a schematic structural diagram illustrating a slot according to another embodiment of the present invention.

FIG. 5 is a schematic structural diagram illustrating a slot according to another embodiment of the present invention. Please refer to FIG. 5, a metal layer 520 includes a slot 521, and an open end of the slot 521 faces a side of the metal layer 520. In the present embodiment, the slot 521 may include a section extending along the first direction D1 and a section extending along the second direction D2. In the present embodiment, the slot 521 may be divided into a first section 521*a* and a second section 521*b*, and a length L1 of the first section 521*a* is equal to a length L2 of the second section 521*b*.

Specifically, the first section 521*a* of the slot 521 may be in a linear shape, and the second section 521*b* of the slot 521 may be in a curved shape. In the present embodiment, the second section 521*b* of the slot 521 may include a first end E1, a second end E2, a first corner T1, a second corner T2, a third corner T3 and a fourth corner T4. In addition, the first end E1 and the first corner T1 are both located at a straight line on the first direction D1. The first corner T1 and the second corner T2 are both located at a straight line on the second direction D2. The second corner T2 and the third corner T3 are both located at a straight line on the first direction D1. The third corner T3 and the fourth corner T4 are both located at a straight line on the second direction D2. It should be noted that, comparing to the embodiment of FIG. 4, the second section 521*b* of the slot 521 of the present embodiment further includes the fourth corner T4, so as to further improve the matching property of the slot antenna device while receiving charging signals of high frequency bands.

Figure 6:
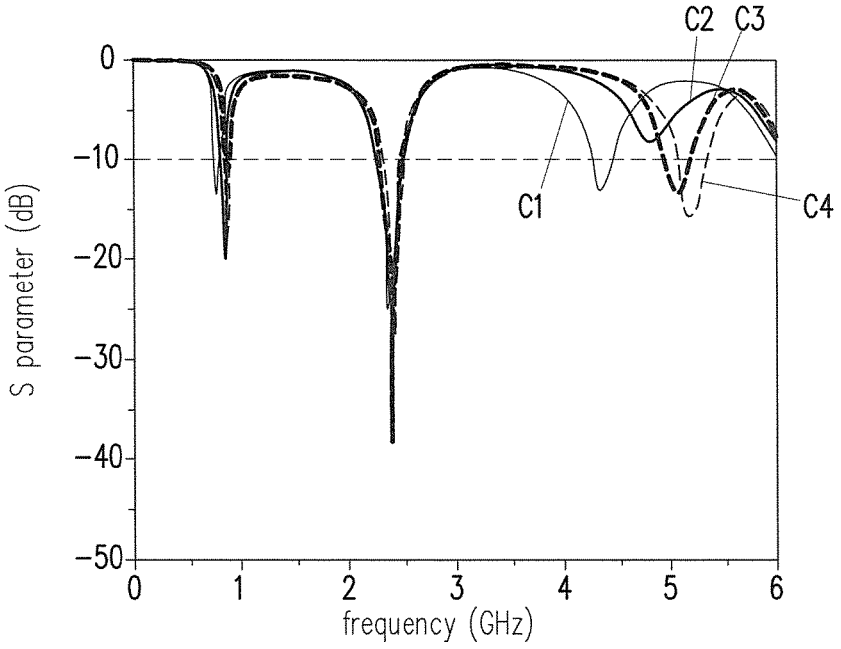
FIG. 6 is a diagram showing S parameters of the slot antenna devices in the embodiments of FIG. 2 through FIG. 5.

More specifically, FIG. 6 is a diagram showing S parameters of the slot antenna devices in the embodiments of FIG. 2 through FIG. 5. Please refer to FIG. 2 through FIG. 6, curves C1 to C4 denote input return loss of the slot structures of FIG. 2 through FIG. 5 at three charging frequency bands. The curve C1 denotes the input return loss of the embodiment of FIG. 2. The curve C2 denotes the input return loss of the embodiment of FIG. 3. The curve C3 denotes the input return loss of the embodiment of FIG. 4. The curve C4 denotes the input return loss of the embodiment of FIG. 5. According to a variation of the curves C1 to C4 of FIG. 6, the slot antenna device of the present invention may receive charging signals of wireless charging frequency bands of 915 MHz, 2.45 GHz and 5.25 GHz via the slot structures of the embodiments shown in FIG. 2 through FIG. 5. Furthermore, the matching property of the slot antenna device while receiving charging signals of high frequency bands may be improved by adjusting a curving degree of the second section of the slot. In particular, a better matching property of high frequency bands may be obtained by the slot structure of the embodiment of FIG. 5.

Regarding the disposition relationship of the slot and the feeding element, several different exemplary embodiments are provided in accompany with FIG. 7 and FIG. 8 as follows.

Figure 7:
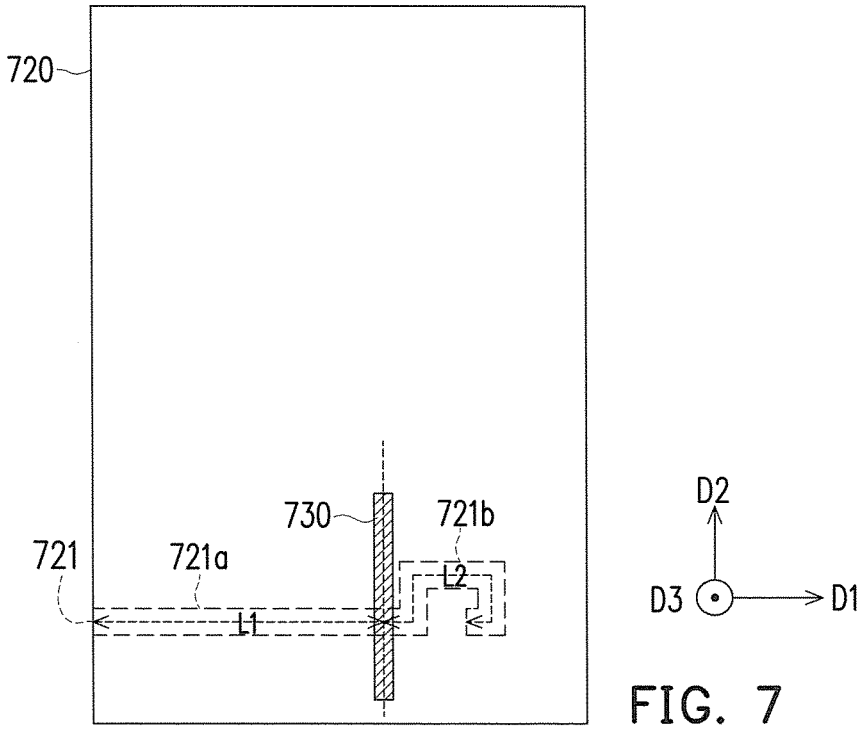
FIG. 7 is a schematic structural diagram illustrating a slot and a feeding element according to an embodiment of the present invention.

FIG. 7 is a schematic structural diagram illustrating a slot and a feeding element according to an embodiment of the present invention. Please refer to FIG. 7, a metal layer 720 includes a slot 721, and an open end of the slot 721 faces a side of the metal layer 720. It should be noted that, in the present embodiment, the metal layer 720 may be disposed on a surface of a substrate of an antenna device, and a feeding element 730 may be disposed on another surface of the substrate. Thus, on the third direction D3, a top view of a disposition relationship of the slot 721 and the feeding element 730 is shown as FIG. 7.

In the present embodiment, the feeding element 730 may be in a linear shape, and extend along the second direction D2. The feeding element 730 crosses the slot 721, so that the slot 721 is divided into a first section 721*a* and a second section 721*b*. A length of the first section 721*a* is equal to a length of the second section 721*b*. In other words, in the present embodiment, if a projection of the feeding element 730 is on the plane in which the slot 721 is located, the projection of the feeding element 730 is disposed at a location at half of the length of the slot 721. In addition, structural characteristics of the slot 721 of the metal layer 720 of FIG. 7 may be sufficiently taught, suggested and explained in the aforementioned example and embodiment of FIG. 5, thus they will not be described herein again.

Figure 8:
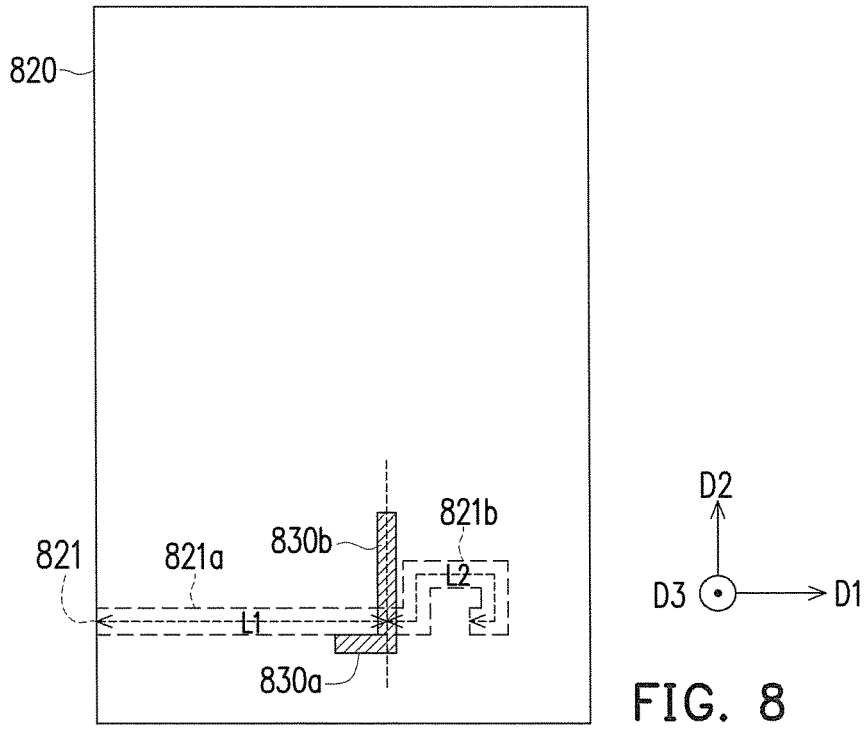
FIG. 8 is a schematic structural diagram illustrating a slot and a feeding element according to another embodiment of the present invention.

FIG. 8 is a schematic structural diagram illustrating a slot and a feeding element according to another embodiment of the present invention. Please refer to FIG. 8, being different from the embodiment of FIG. 7, in the present embodiment, a feeding element has a first line section 830*a* extending along the first direction D1 and a second line section 830*b* extending along the second direction D2. In the present embodiment, if a projection of the feeding element is on the plane in which the slot 821 is located, a projection of the second section 821*b* of the feeding element crosses the slot 821. That is, comparing to the embodiment of FIG. 7, the feeding element of the present embodiment may be designed to be a L-shape, in order to improve a frequency bandwidth property of the slot antenna device while receiving charging signals of each frequency band. In addition, structural characteristics of the slot 821 of the metal layer 820 of FIG. 8 may be sufficiently taught, suggested and explained in the aforementioned example and embodiment of FIG. 5, thus they will not be described herein again.

A frequency bandwidth variation of received charging signals of wireless charging frequency bands of 915 MHz, 2.45 GHz and 5.25 GHz of the embodiments of FIG. 7 and FIG. 8 is shown in table 1 as follows.

TABLE 1

| Type | | S parameter (dB) | Frequency bandwidth (%) |
|---|---|---|---|
| Embodiment of FIG. 7 | 915 MHz | −7.9 | 0 (without an operation range) |
| | 2.45 GHz | −17.5 | 6.9 |
| | 5.25 GHz | −14 | 4.6 |
| Embodiment of FIG. 8 | 915 MHz | −13.4 | 6.5 |
| | 2.45 GHz | −15.5 | 7.4 |
| | 5.25 GHz | −18.8 | 5.1 |

According to Table 1 as above, the feeding element and the slot structure may be designed according to the embodiments of FIG. 7 and FIG. 8, so as to receive charging signals of frequency bands of 915 MHz, 2.45 GHz and 5.25 GHz. In particular, if the structure and disposition relationship of the feeding element and the slot are as shown in the embodiment of FIG. 8, an improved frequency bandwidth property may be obtained by the slot antenna device used for receiving charging signals of each frequency band.

Figure 9:
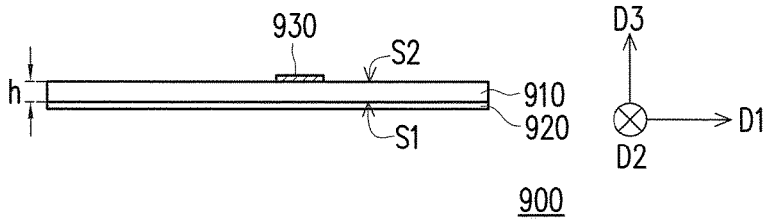
FIG. 9 is a side view illustrating a slot antenna device according to an embodiment of the present invention.

FIG. 9 is a side view illustrating a slot antenna device according to an embodiment of the present invention. Please refer to FIG. 9, a side view of the slot antenna devices of the aforementioned embodiments of FIG. 7 and FIG. 8 may be shown as FIG. 9. In the present embodiment, a slot antenna device 900 includes a substrate 910, a metal layer 920 and a feeding element 930. The substrate 910 has a first surface S1 and a second surface S2. The metal layer 920 is disposed on the first surface S1 of the substrate 910, and the feeding element 930 is disposed on the second surface S2 of the substrate 910. In addition, in the present embodiment, the substrate 910 has a thickness h, wherein the thickness h is 0.4 mm, but the present invention is not limited thereto. In an embodiment, the thickness h of the substrate 910 may be determined according to different wireless charging frequency bands.

Figure 10:
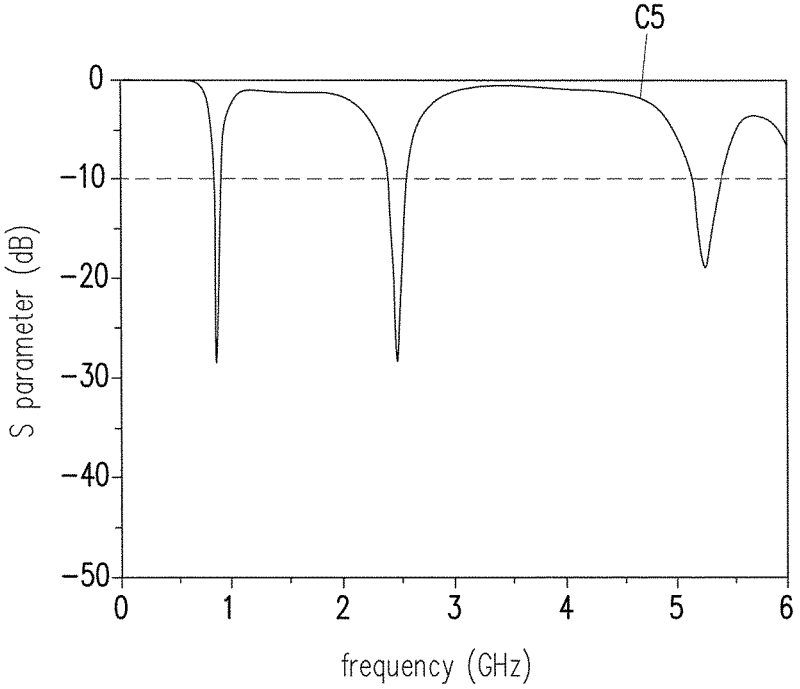
FIG. 10 is a diagram showing S parameters of the slot antenna device in the embodiment of FIG. 8.

FIG. 10 is a diagram showing S parameters of the slot antenna device in the embodiment of FIG. 8. Please refer to FIG. 8 and FIG. 10, the curve C5 denotes an input return loss of the embodiment of FIG. 8. Specifically, if a slot antenna device has the structural characteristics and disposition relationship of the slot and the feeding element in the aforementioned embodiment of FIG. 8, then an input return loss of the slot antenna device may have a S parameter result as shown in FIG. 10. In other words, a slot antenna device based on the structure of FIG. 8 may be operated at wireless charging frequency bands of 915 MHz, 2.45 GHz and 5.25 GHz, and may have a great frequency bandwidth property, and a better matching property at high frequency bands.

Figure 11:
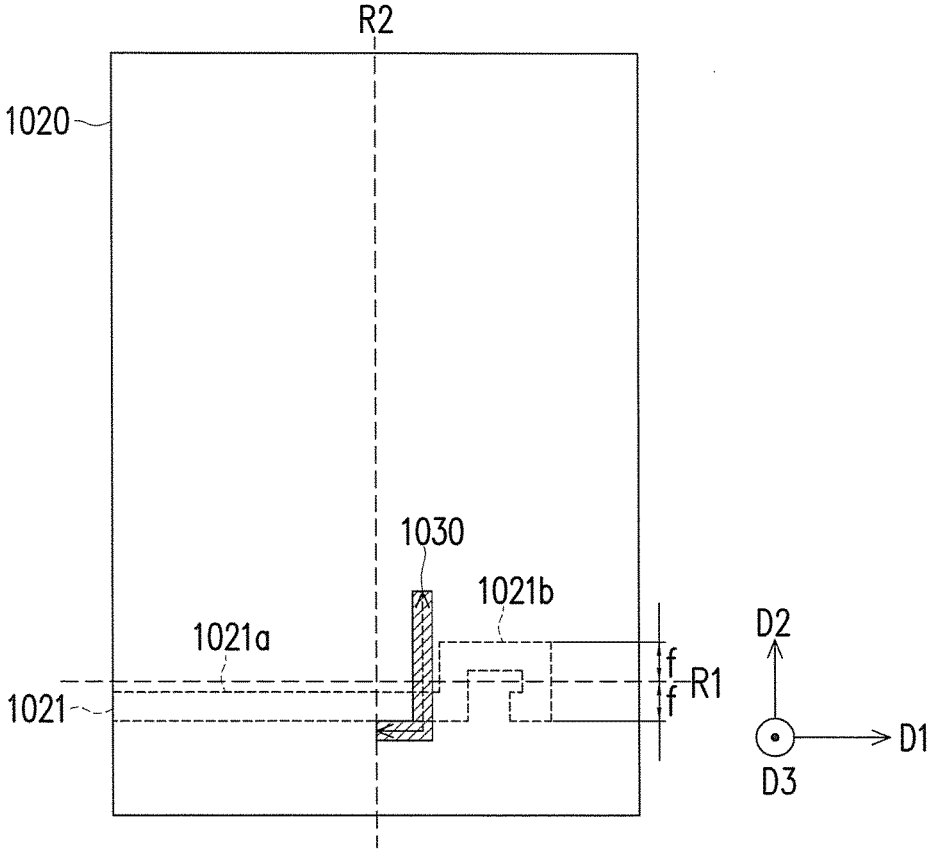
FIG. 11 is a schematic diagram illustrating a reference line of a bended slot antenna device according to an embodiment of the present invention.

FIG. 11 is a schematic diagram illustrating a reference line of a bended slot antenna device according to an embodiment of the present invention. Please refer to FIG. 11, in the present embodiment, a metal layer 1020 includes a slot 1021, and an open end of the slot 1021 faces a side of the metal layer 1020. In the present embodiment, the metal layer 1020 may be disposed on a surface of a substrate of an antenna device, and a feeding element 1030 may be disposed on another surface of the substrate. Thus, on the third direction D3, a top view of a disposition relationship of the slot 1021 and the feeding element 1030 is shown as FIG. 11.

In the present embodiment, the substrate of the slot antenna device may be a flexible substrate, thus the substrate may be bended along a first reference line R1 on the first direction D1 or bended along a second reference line R2 on the second direction D2. Specifically, in the present embodiment, the first reference line R1 may be located at a midline position of a projection of the slot 1021 on the second direction D2. The first reference line R1 and opposite sides of a projection of the slot 1021 on the second direction D2 have the same distance f in between. Therefore, when the substrate is bended along the first reference line R1, the slot 1021 and the feeding element 1030 are bended. Moreover, in the present embodiment, the second reference line R2 may be located in the first section 102*a* of the slot 1021, and does not cross the feeding element 1030. Thus, when the substrate is bended along the second reference line R2, a portion of the first section 1021*a* of the slot 1021 and another portion of the first section 1021*a* of the slot 1021 are in different planes.

Figure 12:
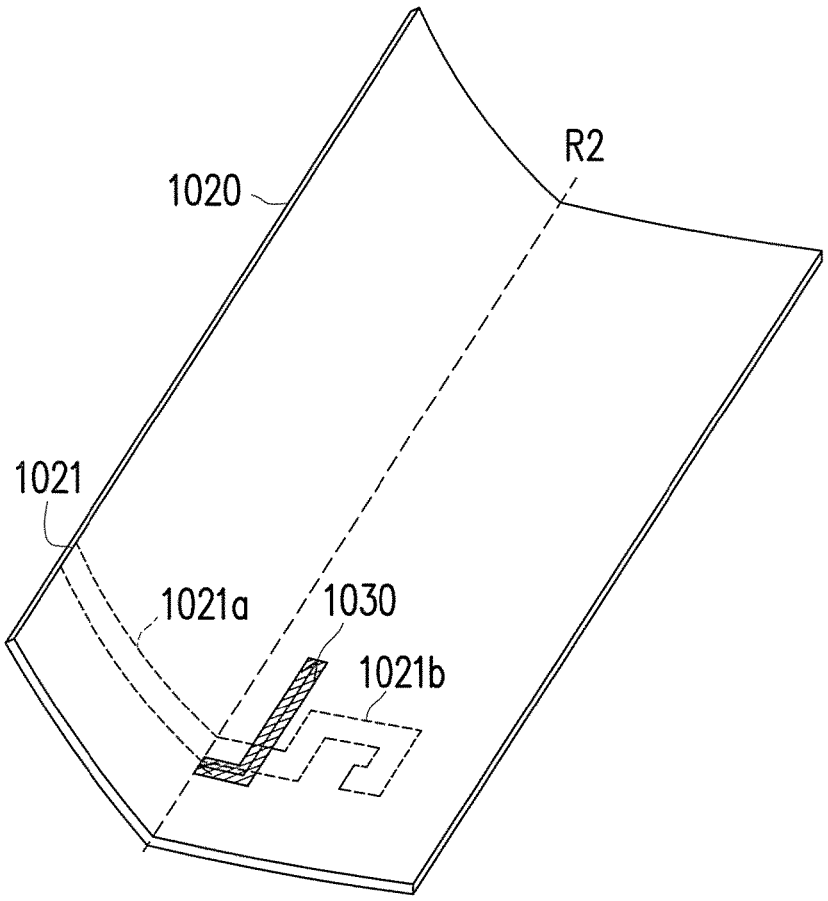
FIG. 12 is a schematic bending diagram illustrating a slot antenna device according to an embodiment of the present invention.

For example, FIG. 12 illustrates a schematic bending diagram of a slot antenna device according to an embodiment of the present invention. In the present embodiment, when the substrate is bended along the second reference line R2 on the second direction D2, a portion of the first section 1021*a* of the slot 1021 and another portion of the first section 1021*a* of the slot 1021 are in different planes. It should be noted that, a bending manner of the substrate of the antenna device of the present invention is not limited to FIG. 12, the substrate may be otherwise bended to form a curved surface, and a vertex of the curved surface passes through the second reference line R2.

As above, in the exemplary embodiments of the present invention, the slot antenna device may receive charging signals of at least three frequency bands by a manner of wireless transmission via the structure of a single feeding element and a single slot. In particular, the length of the slot structure of the slot antenna device is designed according to quarter wavelength of the frequency bands at which the slot antenna device is to be operated, and the feeding position is determined to be half of the length of the slot structure.

Moreover, in the exemplary embodiments of the present invention, the matching property of the slot antenna device at high frequency bands may be efficiently improved via the curved slot structure and the design of the L-shape feeding element, and the frequency bandwidth property of the slot antenna device while receiving charging signals of each frequency band is also improved. In addition, the slot antenna device of the present invention may be applied on flexible substrates, so that the slot antenna device may be disposed in various electronic products in a bended manner.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A slot antenna device, adapted to be operated at an at least three frequency bands, comprising:

a substrate, having a first surface and a second surface opposite to the first surface;

a metal layer, disposed on the first surface, and comprises a slot extending along a first direction; and a feeding element, disposed on the second surface, and extended along a second direction, wherein the first direction is perpendicular to the second direction, wherein a slot length of the slot is a sum of each quarter wavelength of at least three frequency bands, and a projection of the feeding element on the first surface crosses the slot, so that the slot is divided into a first section and a second section, wherein a slot length of the first section is equal to a slot length of the second section.

2. The slot antenna device as claimed in claim 1, wherein the first section comprises an open end of the slot, and the second section comprises a closed end of the slot.

3. The slot antenna device as claimed in claim 1, wherein the first section of the slot is in a linear shape.

4. The slot antenna device as claimed in claim 1, wherein the second section of the slot is in a curved shape.

5. The slot antenna device as claimed in claim 1, wherein the second section of the slot comprises a first end, a second end, a first corner and a second corner, and the first end and the first corner are both located at a straight line on the first direction, the first corner and the second corner are both located at a straight line on the second direction.

6. The slot antenna device as claimed in claim 5, wherein the second section of the slot further comprises a third corner, and the second corner and the third corner are both located at a straight line on the first direction.

7. The slot antenna device as claimed in claim 6, wherein the second section of the slot further comprises a fourth corner, and the third corner and the fourth corner are both located at a straight line on the second direction.

8. The slot antenna device as claimed in claim 1, wherein the feeding element is a metal microstrip, and a resistance value of the feeding element is 50 ohm.

9. The slot antenna device as claimed in claim 1, wherein the feeding element is in a linear shape.

10. The slot antenna device as claimed in claim 1, wherein the feeding element has a first line section extending along the first direction and a second line section extending along the second direction, and a projection of the second line section on the first surface crosses the slot.

11. The slot antenna device as claimed in claim 1, wherein the substrate is a flexible substrate, and the substrate is bended along a first reference line on the first direction or bended along a second reference line on the second direction.

12. The slot antenna device as claimed in claim 11, wherein the first reference line is located at a midline position of a projection of the slot on the second direction.

13. The slot antenna device as claimed in claim 11, wherein the second reference line is located in the first section of the slot, and does not cross the feeding element.

14. The slot antenna device as claimed in claim 1, wherein the slot antenna device is used for receiving a charging microwave of the at least three frequency bands, and the at least three frequency bands comprises 915 MHz, 2.45 GHz and 5.25 GHz.

15. The slot antenna device as claimed in claim 1, wherein a thickness of the substrate is 0.4 mm.

* * * * *